US012364350B2

(12) United States Patent
Vricos

(10) Patent No.: US 12,364,350 B2
(45) Date of Patent: Jul. 22, 2025

(54) COMBINATION SHEET AND COMFORTER

(71) Applicant: James H. Vricos, Clearwater, FL (US)

(72) Inventor: James H. Vricos, Clearwater, FL (US)

( * ) Notice: Subject to any disclaimer, the term of this patent is extended or adjusted under 35 U.S.C. 154(b) by 396 days.

(21) Appl. No.: 17/948,636

(22) Filed: Sep. 20, 2022

(65) Prior Publication Data

US 2023/0091152 A1 Mar. 23, 2023

Related U.S. Application Data

(60) Provisional application No. 63/246,481, filed on Sep. 21, 2021.

(51) Int. Cl.
*A47G 9/04* (2006.01)
*A47G 9/02* (2006.01)

(52) U.S. Cl.
CPC ..... *A47G 9/04* (2013.01); *A47G 9/0223* (2013.01); *A47G 9/0238* (2013.01)

(58) Field of Classification Search
CPC ..... A47G 9/02; A47G 9/04
See application file for complete search history.

(56) References Cited

U.S. PATENT DOCUMENTS 2,145,715 A * 1/1939 Dick ..... A47G 9/0238 139/383
2,799,870 A * 7/1957 Sullivan ..... A47G 9/0238 5/495
5,321,862 A * 6/1994 Campbell ..... A47C 21/022 5/923
5,887,299 A 3/1999 Phillips
6,886,197 B1 5/2005 Madigan
8,898,834 B1 12/2014 Huber et al.
9,549,625 B1 1/2017 Wilkinson et al.
10,624,475 B2 4/2020 Holt
10,674,844 B2 6/2020 Stinchcomb
10,945,542 B2 3/2021 Muthanandam
2008/0104751 A1 * 5/2008 Friedland ..... A47G 9/02 5/502
2011/0289686 A1 12/2011 Chose

* cited by examiner

*Primary Examiner* — David R Hare
*Assistant Examiner* — Joseane E. Tejada
(74) *Attorney, Agent, or Firm* — Jacob M. Ward; Ward Law Office LLC

(57) ABSTRACT

A bedding system can include a combination sheet and comforter. A sheet can be removably affixed to a comforter. Connecting the sheet and the comforter can be accomplished by the use of buttons, hook and loop fastener, ribbon, cloth ties, or hooks. A top side of the sheet can include an array of buttons in columns and rows. An amount of buttons can be adjusted based on an intended size of the bedding system. The comforter can include a plurality of buttonholes, where each of the buttonholes on the comforter corresponds to one of the buttons of the sheet. It should be appreciated that each of the buttons and the buttonholes can be disposed in various patterns, arrangements, or arrays so long as the pattern of the buttons of the sheet corresponds to the pattern of the buttonholes of the comforter.

12 Claims, 3 Drawing Sheets

COMBINATION SHEET AND COMFORTER

CROSS-REFERENCE TO RELATED APPLICATIONS

This application claims the benefit of U.S. Provisional Application No. 63/246,481, filed on Sep. 21, 2021. The entire disclosure of the above application is incorporated herein by reference.

FIELD

The present disclosure relates to bedding and, more specifically, to a bed sheet for coupling to a comforter.

INTRODUCTION

This section provides background information related to the present disclosure which is not necessarily prior art.

Comforters, such as those containing down or feathers, provide an extra layer of comfort and warmth to those who choose to use them while sleeping. However, the filler (e.g., natural down, feathers, and/or synthetic fibers) used in the comforter is typically very difficult to clean, and repetitive cleaning can impact the quality of the filler itself. In order to diminish the need for cleaning, comforters are often covered with a protective cover or used in conjunction with a sheet. For example, the cover can partially or completely enclose the comforter and prevent direct contact between a user and the comforter surface, thereby protecting the comforter and filler contained therein. Likewise, a sheet positioned between the comforter and the user can perform in a similar fashion. Protective covers or sheets can be used in conjunction with various bed coverings, and reference to a "comforter" herein applies equally to substantially equivalent bed coverings such as various styles of comforters, duvets, blankets, and quilts that are typically used as an upper bedding layer and typically of heavier weight than a sheet.

An alternative to sleeping under a comforter is sleeping under a top sheet only of a bed setting. While a top sheet is much easier to clean than a comforter or a comforter cover, it does not provide the same degree of warmth and comfort as a comforter does. Further, the downside of using a top sheet only as a cover is exacerbated when one considers the desire to create a "neat" looking bed, in which the top sheet must be aligned with the bottom sheet and then tucked into the mattress. Further yet, top sheets tend to shift and get tangled with other bed coverings during sleep, causing discomfort. Many people, especially young children and adolescents, often forego aligning their bed sheets when such a task proves too difficult and/or time-consuming.

It is therefore common for people to forego the use of a top sheet and, instead, sleep on the bottom sheet using only a single cover; e.g., a comforter or a comforter with a cover. However, contact between a person's skin and the comforter or comforter cover itself necessitates the cleaning of the comforter or comforter cover more often than a comforter or comforter with a cover that sits on top of a clean top sheet. Further, to clean the comforter cover, the comforter must be removed from the comforter cover. The process of removing the comforter from the comforter cover can be difficult and time-consuming. Moreover, re-inserting the comforter into a laundered comforter cover can prove quite aggravating as the comforter, as well as the filler container therein, tends to gather or bunch unevenly, and it can be difficult to manipulate the comforter into each corner of the comforter cover in an even fashion. Indeed, the time consumption and aggravation associated with cleaning a comforter cover convinces many people to wash their comforter cover much less often than they should or likely desire to. Alternatively, for those who clean their comforter cover frequently, these covers fade and become further worn with time.

There is a continuing need for an improved bedding system that more easily permits alignment of a comforter and corresponding sheet, while allowing the sheet to be removed, laundered, and reinstalled on the comforter in a consistent fashion.

SUMMARY

In concordance with the instant disclosure, an improved bedding system including a bed sheet for coupling to a comforter, has been surprisingly discovered.

In certain embodiments, a bed sheet for coupling to a comforter is provided, where the bed sheet includes a textile and a plurality of fastening means arranged on the textile. The textile includes a length, a width, and an edge defining a perimeter thereof. An interior of the textile is bounded by the edge. The plurality of fastening means is arranged on the textile, where at least a portion of the fastening means is arranged on the interior of the textile. The plurality of fastening means is configured to couple a first side of the bed sheet to a first side of the comforter.

In certain embodiments, a bedding system is provided. The bedding system includes a comforter and a bed sheet for coupling to the comforter. The bed sheet can be a top sheet of the bedding system, which can also include a bottom sheet or fitted sheet for covering a mattress. The comforter can include any substantially equivalent bed covering, such as various styles of comforters, duvets, blankets, and quilts that are typically used as an upper bedding layer and typically of heavier weight than a sheet. The comforter can include a filler; e.g., natural down, feathers, and/or synthetic fibers.

In certain embodiments, a method of coupling a bed sheet and a comforter is provided. The method can utilize a bed sheet for coupling to the comforter, as described herein. The first side of the bed sheet can be coupled to the first side of the comforter using the plurality of fastening means. The first side of the bed sheet can also be uncoupled from the first side of the comforter using the plurality of fastening means.

In certain embodiments, a method of using a bedding system is provided. The method can utilize a bed sheet for coupling to the comforter, as described herein, where the first side of the bed sheet is coupled to the first side of the comforter using the plurality of fastening means. The method can include uncoupling the first side of the bed sheet from the first side of the comforter using the plurality of fastening means, which can then be followed by laundering the uncoupled bed sheet.

The bedding system of the present disclosure provides certain benefits and advantages over other bedding products. The bedding system allows a user to sleep with reduced interruptions caused by sheets and coverings that have separated, resulting in the coverings either not covering the user properly or covering in a disorderly manner. The bedding system can provide users with the ability to dramatically reduce the time it takes to "make" the bed, and can provide aesthetic benefits through the use of decorative buttons, sheets, and coverings. When used for children's bedding, the system serves as an educational tool that teaches the child user to make his/her bed easily and quickly through the use of standard sheets and bed coverings rather that duvets and other bedding products. The bedding system can also provide the child user with an experience typically attributed to playing with toys and the use of decorations that appeal to children by using illustrated buttons, sheets, and coverings. The bedding system can allow older and infirmed individuals to make their beds with less physical exertion. The user can wash or clean bedding with no more effort or expense that that of cleaning standard bedding, unlike products like traditional comforters.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
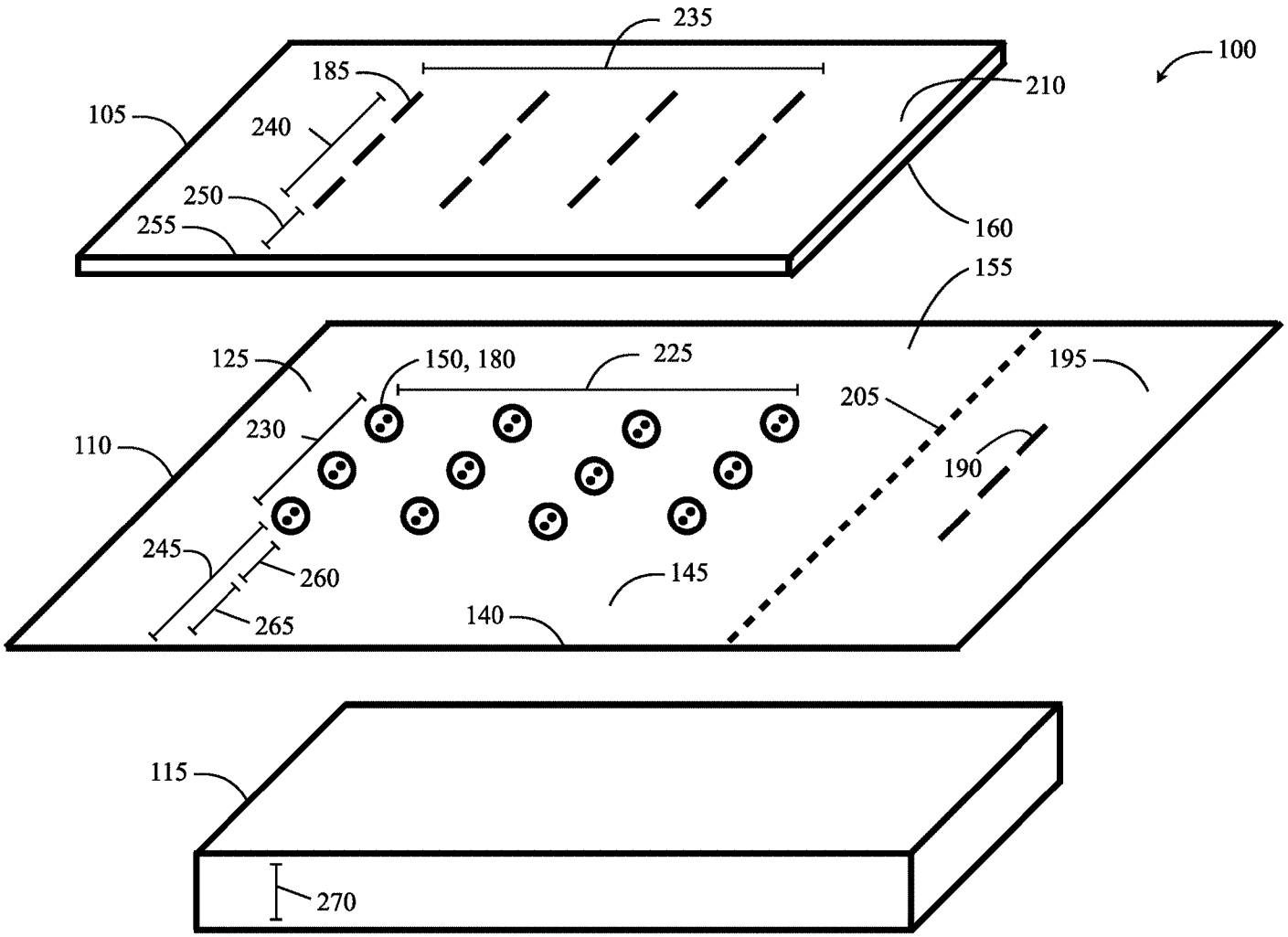
FIG. 1 is top perspective exploded view of a bedding system including a comforter, a bed sheet, and a fitted sheet installed on a mattress, constructed in accordance with the present technology.
Figure 2:
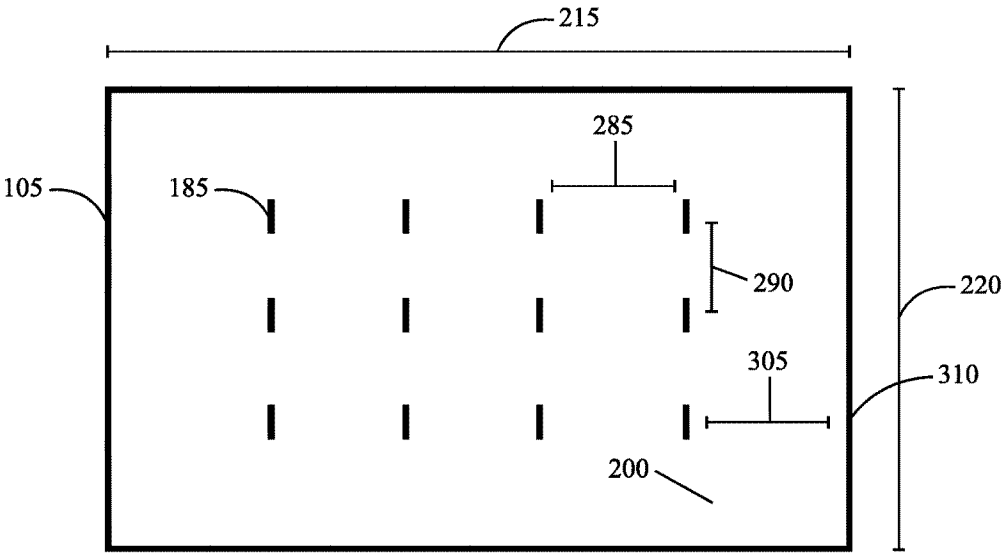
FIG. 2 is a top plan view of the comforter.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology is drawn to a bed sheet for coupling to a comforter, where the bed sheet includes a textile and a plurality of fastening means arranged thereon. The textile has a length, a width, an edge defining a perimeter thereof, and an interior bounded by the edge. The plurality of fastening means arranged on the textile is configured so that at least a portion of the fastening means is arranged on the interior of the textile and so that the plurality of fastening means is configured to couple a first side of the bed sheet to a first side of the comforter. The textile can include any woven, nonwoven, or knit textile, including various fiber-based materials formed of natural and/or synthetic fibers, yarns, filaments, threads, and different fabric types. It is understood that the comforter can include any substantially equivalent bed covering, such as various styles of comforters, duvets, blankets, and quilts that are typically used as an upper bedding layer and typically of heavier weight than a sheet. It is further understood that the comforter can include one or more types of filler, such as natural down, feathers, and/or synthetic fibers.

Embodiments of the plurality of fastening means can include one or more of the following various aspects. At least one of the fastening means can be closer to a center of the interior of the textile than the edge of the textile. The plurality of fastening means can be arranged in a two-dimensional array on the textile, such as where the two-dimensional array includes a plurality of rows and a plurality of columns. A particular embodiment includes where the plurality of rows includes three rows and the plurality of columns includes four columns. It should be appreciated that the plurality of fastening means can be disposed in other patterns, arrangements, or arrays so long as the fastening means arranged on the textile corresponds to compatible coupling pattern of the comforter. E.g., buttons as fastening means on the bed sheet and buttonholes on the comforter.

An entirety of the plurality of fastening means can be arranged on the interior of the textile and the entirety of the plurality of fastening means can be arranged at least four inches from the edge. Other embodiments include where the plurality of fastening means is arranged from four inches to thirty inches from the edge, from six inches to twenty-four inches from the edge, and from eight inches to twelve inches from the edge. A particular embodiment includes where the entirety of the plurality of fastening means is arranged at least twelve inches from the edge.

Other aspects of the plurality of fastening means can include one or more of the following. The plurality of fastening means arranged on the textile can include a plurality of first fastening means configured to couple to a plurality of second fastening means arranged on the comforter. Examples include where the plurality of first fastening means and the plurality of second fastening means include complementary button and buttonhole fasteners, complementary hook-and-loop fasteners, complementary snap fit fasteners, complementary hook and eye fasteners, complementary magnetic fasteners, complementary laces and eyelets, and/or complementary ribbons or ties. A particular embodiment includes where the plurality of first fastening means includes one of a plurality of buttons and a plurality of buttonholes and the plurality of second fastening means includes the other one of the plurality of buttons and the plurality of buttonholes.

The plurality of fastening means arranged on the textile can further include a plurality of third fastening means on a portion of the textile, where the portion of the textile is configured to fold over a portion of the comforter. The plurality of third fastening means can be configured to couple the portion of the textile to a second side of the comforter. A particular embodiment includes where the plurality of first fastening means includes a plurality of buttons, the plurality of second fastening means includes a plurality of buttonholes, and the plurality of third fastening means includes another plurality of buttonholes, where the another plurality of buttonholes is configured to couple with a portion of the plurality of buttons after the portion of the plurality of buttons is coupled to a portion of the plurality of buttonholes. The portion of the textile configured to fold over the portion of the comforter can include a hemmed side of the bed sheet.

The present technology is further drawn to a bedding system that includes a comforter and a bed sheet for coupling to the comforter. The comforter and the bed sheet can be configured as described herein. The comforter, which includes various styles of comforters, duvets, blankets, and quilts, can be packaged with the bed sheet, where the bed sheet is configured as a top sheet. The comforter and bed sheet can be provided uncoupled or coupled together. The bedding system can further include a bottom sheet, which can be configured as a fitted sheet, as well as one or more pillowcases. The bedding system can hence provide an aesthetically pleasing set of bedclothes, where the special technical effect of having the bed sheet coupled to the comforter allows a user to sleep with without interruptions caused by sheets and coverings that have separated, and where the bedding system maintains proper and orderly covering of the user during the sleep session.

The present technology is still further drawn to ways of using a bed sheet and a comforter configured as described herein. For example, a method of using a bed sheet for coupling to the comforter can include coupling the first side of the bed sheet to the first side of the comforter using the plurality of fastening means as well as uncoupling the first side of the bed sheet to the first side of the comforter using the plurality of fastening means. Where the plurality of fastening means arranged on the textile further includes a plurality of third fastening means on a portion of the textile, the portion of the textile can be configured to fold over a portion of the comforter such that the plurality of third fastening means can be configured to couple the portion of the textile to a second side of the comforter. In this way, the portion of the textile can be folded over the portion of the comforter and the portion of the textile can be coupled to the second side of the comforter using the plurality of third fastening means.

The present technology is still further drawn to ways of using a bedding system, where the bedding system includes a comforter a bed sheet for coupling to the comforter, as described herein. When the first side of the bed sheet is coupled to the first side of the comforter using the plurality of fastening means, a method of use can include uncoupling the first side of the bed sheet from the first side of the comforter using the plurality of fastening means followed by laundering the uncoupled bed sheet. This allows the uncoupled bed sheet to be laundered without the comforter.

Aspects of the bed sheet for coupling to a comforter can include the following features. The bed sheet can have a fold line, in which the bed sheet can be folded back over a top edge of the comforter. The fold line can be part of a design in the aesthetic appearance of the bed sheet and can continue one or more design elements of the comforter and/or can accent the comforter. Where a portion of the bed sheet is folded over a top or the second side of the comforter, the folded over portion can further protect the comforter where the user's upper body, including the user's arms, may come in contact with the top or second side of the comforter. In this way, the bed sheet can further maintain cleanliness of the comforter, thereby necessitating that only the bed sheet be laundered on a regular basis.

Other aspects include where the edges of both the bed sheet and the comforter are sized to align with each other such that the bed sheet can be within one inch of a size of the comforter. It is also possible to have the bed sheet sized larger than the comforter; e.g., where the left, right, and bottom sides of the bed sheet extend beyond the edge of the comforter, thereby allowing the user to tuck the left, right and bottom sides of the bed sheet down the sides and underneath the mattress, as desired. The comforter can also be sized to extend at or below a bottom edge of the mattress, depending on a desired sizing of the bedding system; e.g., king, queen, twin, single, etc. This can provide a neat and aesthetically pleasing effect whether the user elects to tuck the bed sheet or not.

EXAMPLES

Example embodiments of the present technology are provided with reference to the several figures enclosed herewith.

With reference to FIGS. 1-4, an embodiment of a bedding system 100 including a comforter 105, a bed sheet 110 for coupling to the comforter 105, and a fitted sheet 115 installed on a mattress 120 is shown. The bed sheet 110 includes a textile 125 having a length 130, a width 135, an edge 140 defining a perimeter thereof, and an interior 145 bounded by the edge 140. A plurality of fastening means 150 is arranged on the textile 125, where at least a portion of the fastening means 150 is arranged on the interior 145 of the textile 125. In the embodiment depicted, an entirety of the fastening means 150 is arranged on the interior 145 of the textile, where there is no instance of a fastening means 150 being positioned on the edge 140. However, it should be understood that one or more fastening means 150 can be positioned on the edge 140 in other embodiments. The plurality of fastening means 150 is configured to couple a first side 155 of the bed sheet 110 to a first side 160 of the comforter 105.

Figure 3:
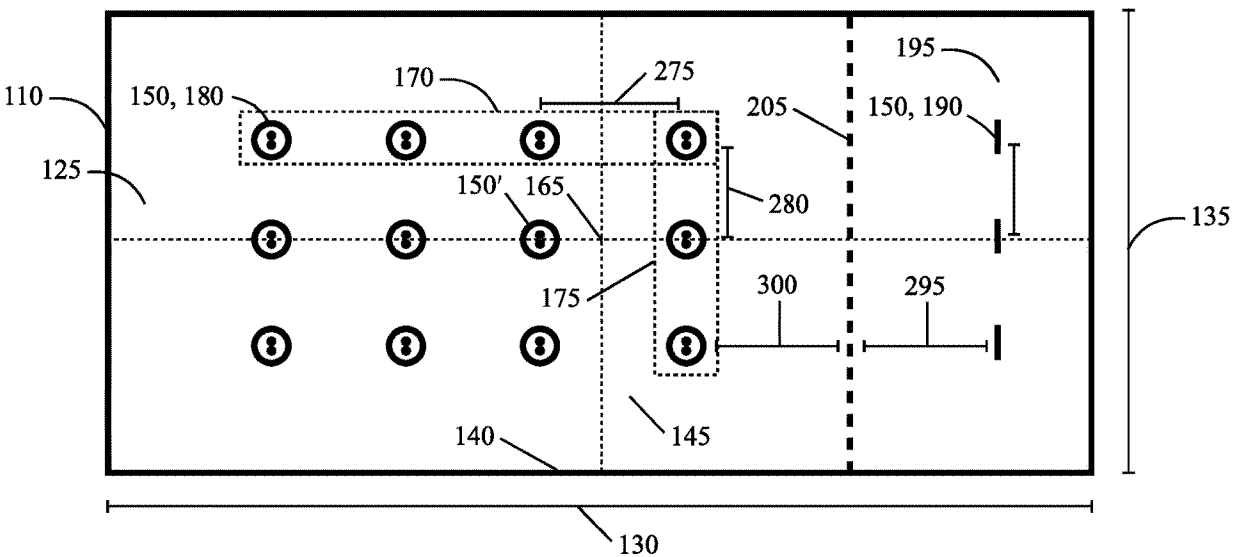
FIG. 3 is a top plan view of the bed sheet.

As shown in FIG. 3, at least one of the fastening means 150' is closer to a center 165 of the interior 145 than the edge 140. The plurality of fastening means 150 is arranged in a two-dimensional array on the textile 125, where in the example depicted, there are three rows 170 and four columns 175, where an instance of a row 170 and a column 175 are each shown bounded by a stippled box. Other arrangements of fastening means 150 can be employed.

Figure 4:
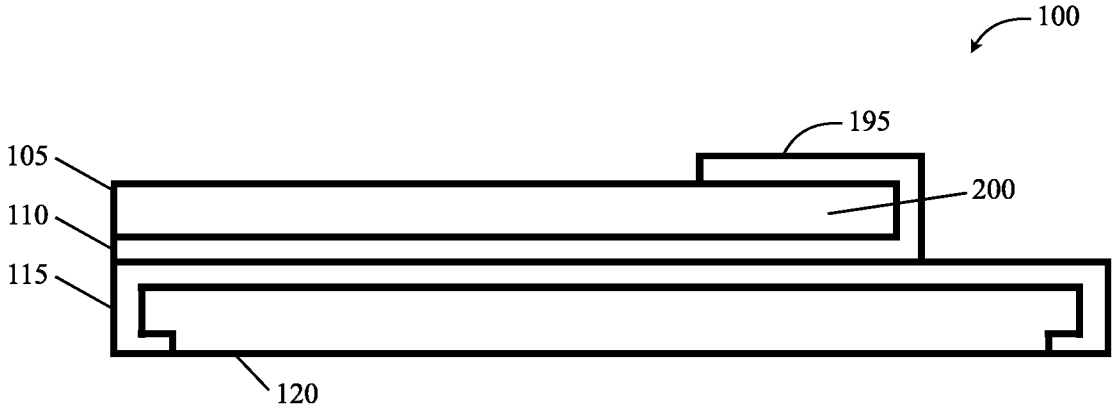
FIG. 4 is a cross-sectional view of the bedding system including the comforter, the bed sheet, and the fitted sheet installed on the mattress.

With further respect to the bed sheet 110, the plurality of fastening means 150 arranged on the textile 125 includes a plurality of first fastening means 180 configured to couple to a plurality of second fastening means 185 arranged on the comforter 105. As shown, the plurality of first fastening means 185 and the plurality of second fastening means 185 have complementary arrangements. The plurality of fastening means 150 arranged on the textile 125 further includes a plurality of third fastening means 190 on a portion 195 of the textile 125. The portion 195 of the textile 125 is configured to fold over a portion 200 of the comforter 105, along fold line 205, as shown in FIGS. 3 and 4. The plurality of third fastening means 190 is configured to couple the portion 195 of the textile 125 to a second side 210 of the comforter 105.

In the embodiment of the bedding system 100 depicted in the figures, the plurality of first fastening means 180 on the textile 125 includes a plurality of buttons, the plurality of second fastening means 185 on the comforter 105 includes a plurality of buttonholes, and the plurality of third fastening means 190 on the textile 125 includes another plurality of buttonholes. In this way, the another plurality of buttonholes is configured to couple with a portion of the plurality of buttons after the portion of the plurality of buttons is coupled to a portion of the plurality of buttonholes and when the portion 195 of the textile 125 is folded over the portion 200 of the comforter 105.

Various sizing and spatial relationships can be applied to the bedding system 100. The length 130 and the width 135 of the textile 125 of the bed sheet 110 can be sized to fit various custom sizes as well as various standard bed sizes, including twin or single, twin XL, full or double, queen, king, and California king bed sizes. In a particular embodiment, the length 130 can be 96 inches and the width 135 can be 66 inches. Likewise, the comforter 105 can have a length 215 and width 220 sized to fit various custom sizes as well as the various standard bed sizes indicated for the bed sheet 110. In a particular embodiment, the length 215 can be 89 inches and the width 220 can be 68 inches. Where a bottom sheet is present, such as the fitted sheet 115 installed on the mattress 120, the fitted sheet 115 can be sized appropriately relative to the comforter 105 and the bed sheet 110. The same applies to the mattress 120.

The plurality of fastening means 150 of the bed sheet 110 (including the plurality of first fastening means 180) can be arranged on the textile 125 in various ways, including an arrangement having a length 225 and width 230. The plurality of second fastening means 185 arranged on the comforter 105 likewise can be arranged in various ways, including an arrangement having a length 235 and a width 240. As provided herein, the plurality of first fastening means 180 and the plurality of second fastening means 185 can form complementary arrangements to facilitate coupling the first side 155 of the bed sheet 110 to the first side 155 of the comforter 105. For example, the length 225 and width 230 of the plurality of first fastening means 180 can match the length 235 and width 240 of the plurality of second fastening means 185. The plurality of first fastening means 180 can also be positioned a distance 245 from the edge 140 of the textile 125. In certain embodiments, the distance 245 can match a distance 250 between the plurality of second fastening means 185 and an edge 255 of the comforter 105. In other embodiments, such as shown in FIG. 1, the distance 245 between the plurality of first fastening means 180 and the edge 140 of the textile 125 can include a distance 260 equal to the distance 250 between the plurality of second fastening means 185 and an edge 255 of the comforter 105 and an additional distance 265 that is greater than a height 270 of the fitted sheet 115 installed on the mattress 120. In this way, the bed sheet 110 can be tucked down the side and under the mattress 120 while the comforter 105 coupled to the bed sheet 110 can lay flat upon the bed sheet 110 when coupled thereto.

The plurality of fastening means 150 of the bed sheet 110 (including the plurality of first fastening means 180) can be arranged on the textile 125 to have a lengthwise distance 275 between instances of the fastening means 150, 180 and a widthwise distance 280 between instances of the fastening means 150, 180. In some embodiments, the lengthwise distance 275 and the widthwise distance 280 are different and, in other embodiments, the lengthwise distance 275 and the widthwise distance 280 are the same. Accordingly, the plurality of second fastening means 185 arranged on the comforter 105 can have a lengthwise distance 285 and a widthwise distance 290 between instances of the second fastening means 185, which can be the same or different. The lengthwise distance 275 and the widthwise distance 280 of the first fastening means 180 can be the same as the lengthwise distance 285 and the widthwise distance 290 of the second fastening means 185.

When the bed sheet 110 includes the plurality of third fastening means 190 on the portion 195 of the textile 125, as shown, the plurality of third fastening means 190 can be positioned a distance 295 from the fold line 205. Distance 295 can be substantially the same as a distance 300 between the plurality of first fastening means 180 and the fold line 205. In this way, when the portion 195 of the textile 125 is folded over the portion 200 of the comforter 105 along the fold line 205, the portion 195 of the textile 125 can be coupled to the second side 210 of the comforter 105 using the plurality of third fastening means 190. That is, first fastening means 180 (e.g., buttons) are coupled to second fastening means 185 (e.g., buttonholes) and then further coupled to third fastening means 190 (e.g., buttonholes). As shown, the distance 300 between the plurality of first fastening means 180 and the fold line 205 of the bed sheet 110 can be substantially the same as a distance 305 between the plurality of second fastening means 185 and a widthwise edge 310 of the comforter 105.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A bedding system, comprising: a comforter; and a bed sheet for coupling to the comforter, including: a textile having a length, a width, an edge defining a perimeter thereof, and an interior bounded by the edge; and a plurality of fastening means arranged on the textile and the comforter, at least a portion of the fastening means arranged on the interior of the textile, the plurality of fastening means configured to couple a first side of the bed sheet to a first side of the comforter; wherein: the width of the bed sheet is greater than a width of the comforter; the plurality of fastening means arranged on the textile includes a plurality of first fastening means configured to couple to a plurality of second fastening means arranged on the comforter; the plurality of fastening means arranged on the textile further includes a plurality of third fastening means on a portion of the textile, the portion of the textile configured to fold over a portion of the comforter, and the plurality of third fastening means configured to couple the portion of the textile to a second side of the comforter; the plurality of first fastening means includes a plurality of buttons; the plurality of second fastening means includes a plurality of buttonholes; the plurality of third fastening means includes another plurality of buttonholes; and the another plurality of buttonholes is configured to couple with a portion of the plurality of buttons after the portion of the plurality of buttons is coupled to a portion of the plurality of buttonholes.

2. The bedding system of claim 1, wherein at least one of the fastening means is closer to a center of the interior than the edge.

3. The bedding system of claim 1, wherein the plurality of fastening means is arranged in a two-dimensional array on the textile.

4. The bedding system of claim 3, wherein the two-dimensional array includes a plurality of rows and a plurality of columns.

5. The bedding system of claim 4, wherein the plurality of rows includes three rows and the plurality of columns includes four columns.

6. The bedding system of claim 1, wherein an entirety of the plurality of fastening means is arranged on the interior of the textile.

7. The bedding system of claim 6, wherein the entirety of the plurality of fastening means is arranged at least four inches from the edge.

8. The bedding system of claim 7, wherein the entirety of the plurality of fastening means is arranged at least twelve inches from the edge.

9. The bedding system of claim 1, wherein the portion of the textile configured to fold over the portion of the comforter includes a hemmed side of the bed sheet.

10. A method of coupling a bed sheet and a comforter, comprising:

providing the bedding system of claim 1; and coupling the first side of the bed sheet to the first side of the comforter using the plurality of fastening means.

11. The method of claim 10, wherein:

the method further comprises folding the portion of the textile over the portion of the comforter and coupling the portion of the textile to the second side of the comforter using the plurality of third fastening means.

12. A bedding system, comprising: a comforter; and a bed sheet for coupling to the comforter including: a textile having a length, a width, an edge defining a perimeter thereof, and an interior bounded by the edge; and a plurality of fastening means arranged on the textile and the comforter, at least a portion of the fastening means arranged on the interior of the textile, the plurality of fastening means configured to couple a first side of the bed sheet to a first side of the comforter; wherein: at least one of the fastening means is closer to a center of the interior than the edge; the plurality of fastening means is arranged in a two-dimensional array on the textile; the plurality of fastening means arranged on the textile includes a plurality of first fastening means configured to couple to a plurality of second fastening means arranged on the comforter; the plurality of fastening means arranged on the textile further includes a plurality of third fastening means on a portion of the textile, the portion of the textile configured to fold over a portion of the comforter, and the plurality of third fastening means configured to couple the portion of the textile to a second side of the comforter; the plurality of first fastening means includes a plurality of buttons; the plurality of second fastening means includes a plurality of buttonholes; the plurality of third fastening means includes another plurality of buttonholes; the another plurality of buttonholes is configured to couple with a portion of the plurality of buttons after the portion of the plurality of buttons is coupled to a portion of the plurality of buttonholes; and the width of the bed sheet is greater than a width of the comforter.

* * * * *